US005165686A

United States Patent [19]

Morgan

[11] Patent Number: 5,165,686

[45] Date of Patent: Nov. 24, 1992

[54] WOODEN BASEBALL BAT

[76] Inventor: Edward H. Morgan, 117 E. 51st St., Savannah, Ga. 31405

[21] Appl. No.: 629,461

[22] Filed: Dec. 18, 1990

[51] Int. Cl.[5] ..... A63B 59/06

[52] U.S. Cl. ..... 273/72 R

[58] Field of Search ..... 273/67, 72, 73 J

[56] References Cited

U.S. PATENT DOCUMENTS

| | | | |
|---|---|---|---|
| 780,244 | 1/1905 | Truesdell | 273/72 R |
| 1,063,563 | 6/1913 | May | 273/72 R |
| 1,367,492 | 2/1921 | Miles | 273/72 R |
| 1,603,904 | 10/1926 | Cohn | 273/72 R |
| 1,665,195 | 4/1928 | Cohn | 273/72 R |
| 2,195,681 | 4/1940 | Robarge | 273/72 R |
| 2,379,006 | 6/1945 | Johnson | 273/67 D |
| 2,458,919 | 1/1949 | Marsden | 273/72 R |
| 3,598,410 | 8/1971 | Costopoulos | 273/72 R |
| 3,877,698 | 4/1975 | Volpe | 273/72 R |
| 4,358,113 | 11/1982 | McKinnon et al. | 273/67 A |

FOREIGN PATENT DOCUMENTS

| | | | |
|---|---|---|---|
| 62069 | 4/1984 | Japan | 273/72 R |
| 664900 | 4/1988 | Switzerland | 273/67 R |
| 7152 | of 1886 | United Kingdom | 273/67 DA |
| 24222 | of 1893 | United Kingdom | 273/67 D |

*Primary Examiner*—William H. Grieb
*Assistant Examiner*—Mark S. Graham
*Attorney, Agent, or Firm*—Roland H. Shubert

[57] ABSTRACT

A reinforcing member is provided within the handle portion of a wooden bat to prevent the heavy barrel portion from separating from the handle and flying through the air with possible injury to onlookers in the event of bat breakage upon impact with a ball. The reinforcing member is of less stiffness than is the wood of the bat so as to not change the flexing characteristics of the bat and is of small diameter and low specific gravity so as to avoid noticeable change in the weight and balance of the bat.

9 Claims, 1 Drawing Sheet

WOODEN BASEBALL BAT

BACKGROUND OF THE INVENTION

1. Field of the Invention:

This invention relates generally to improvements in the construction of bats.

More particularly, this invention relates to a safety means for baseball bats which does not affect the weight or balance of the bat.

2. Description of the Related Art:

Wooden baseball bats occasionally fail in use breaking at the handle upon impact with a pitched ball. The barrel portion of the bat separates from the handle and flies through the air. There is the likelihood of serious injury if the heavy barrel portion strikes a person.

It has been proposed in the prior art to provide various means to reinforce the bat and to prevent its breaking or to keep the parts from separating in the event the bat did break. One such prior art approach is illustrated by U.S. Pat. No. 1,603,904 to Cohn. Cohn discloses a baseball bat having a reinforcing rod extending axially the length of the bat. The reinforcing rod is described as a shaft, preferably of steel, secured at one end by threaded engagement with a base plate. The other end of the shaft is screwed into an elongated boss on a cap which is secured to the end of the bat.

A later patent to the same inventor, U.S. Pat. No. 1,665,195, describes generally a bat having a central longitudinal passage therethrough and having an enlarged passage bore at the upper and lower extremities of the bat. A metallic rod, screw threaded at both ends, is disposed in the passage. Threaded metal plugs are disposed in the enlarged passage bore at the bat ends and are screw threaded onto the rod. The rod acts as a reinforcing member which, the inventor asserts, will prevent bat breakage in most instances. Should the bat break, the metal plugs on the shaft ends will hold the broken bat pieces together.

More recently, there has been a trend toward using metal bats, especially in the game of softball. Such bats are usually made of a die cast aluminum or magnesium alloy. Metal bats do provide certain advantages over wooden bats in that metal bats seldom crack split, or break. Even though metal bats provide safety advantages over wooden ones, use of metal bats has not been well received by serious baseball players and in fact metal bats are not allowed for use in many leagues.

Even though metal bats are inherently less susceptible to breakage in use than are wooden ones, the prior art nevertheless discloses the use of reinforcing members extending axially the length of a metal bat. One such disclosure is found in U.S. Pat. No. 3,801,098 to Gildenmeister. That patent discloses a hollow, die cast metal bat having the barrel end open and having a knob at the end of the handle portion. The interior volume of the bat is filled with a structural foam, such as a rigid polyurethane foam, and a cap is then formed over the barrel end of the bat. A wire extending axially within the rigid foam extends the length of the bat and is anchored at its ends adjacent the bat knob and cap.

Another approach to the manufacture of reinforced metal bats is shown in a patent to Krieger, U.S. Pat. No. 4,056,267. Krieger produces a bat having a unitary metal skin structure and having a safety-strengthening device in the interior of the bat. The bat structure is die cast from a metal such as magnesium and an end cap of the same metal is welded onto the end of the bat. Before the end cap is welded in place, a strengthening device comprising a metal rod having an anchoring means at each end is placed into the hollow bat. Thereafter, the interior of the bat is filled with a resilient foam material which strengthens the structure and dampens vibrations. The strengthening device serves a dual purpose. It acts like a backbone or spine for the bat giving the bat extra longitudinal strength which reduces the tendency of the bat to crack. it also serves to prevent the complete separation of the broken piece of the bat when there occurs a sudden fracture of the entire bat.

Reinforced bats of the kind disclosed by the two Cohn patents have a number of serious disadvantages which have precluded their acceptance for use in games. The steel reinforcing rod used by Cohn is far stiffer than is the wood which it replaces and is far higher in specific gravity. Consequently, the flexibility and feel of the bat is considerably changed. The end caps and base plates which Cohn uses to secure his steel reinforcing rod are also of metal which adds weight to the bat and significantly changes its balance. Metal bats of the kind described in the Gildemeister and Krieger patents are commonly used in amateur play, particularly in the game of softball,but have not found acceptance with serious players or in professional baseball.

Even though wooden bats frequently break in use, thus creating the possibility of injury, the safety measures and alternative materials for bat construction proposed by the prior art have in large part been rejected. No approach taken in the prior art prevents the separation of the broken piece of a bat from the handle portion without also adversely affecting the weight, balance, feel, flexibility and sound of the traditional wooden bat. Hence, ball players can readily appreciate the advantages offered by a bat construction which preserves the characteristics of the traditional bat while preventing a broken piece from completely separating from the handle portion.

SUMMARY OF THE INVENTION

A wooden bat is provided with a flexible reinforcing member which is disposed centrally within the bat along the axis thereof and extends from the handle end into the enlarged tapered portion of the bat. The reinforcing member must have a high tensile strength and a relatively low specific gravity and display a stiffness less than that of the wood of the bat. Composites of high tensile strength fibers of carbon and like materials in a polymer matrix are preferred as the reinforcing member. The member is formed into a small diameter rod which is adhesively secured to the bat over the entire rod surface.

Hence, it is an object of this invention to provide means adapted to increase the safety of a wooden bat without affecting its characteristics.

It is another object of this invention to provide means to prevent a broken bat end from separating from the handle portion of the bat.

Other objects will become apparent from the following description of preferred embodiments of the invention.

BRIEF DESCRIPTION OF THE DRAWING

The invention is more fully illustrated by the drawing in which.

DESCRIPTION AND DISCUSSION OF THE INVENTION

Figure 1:
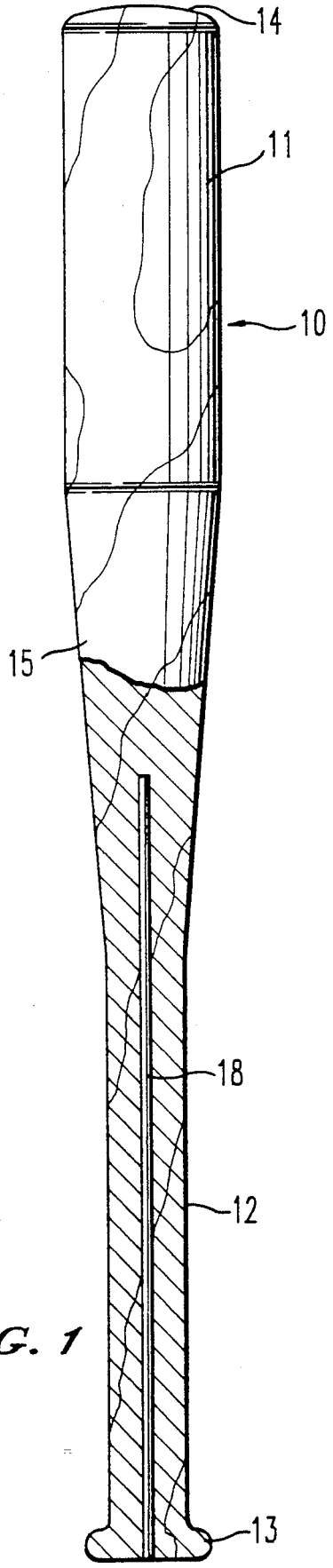
FIG. 1 is a partial sectional view of a bat constructed in accordance with this invention.

With reference first to FIG. 1 of the drawing, a bat 10 of traditional configuration and size is turned from seasoned ash or other suitable wood. The bat itself has a large barrel section and a handle portion 12 with an integral knob 13 on the end thereof. The end 14 of the barrel section is of generally rounded configuration. A tapered bat portion 15 forms a transition between the relatively small diameter handle portion 12 and the larger barrel section 11. The relative lengths of the handle, the taper, and the barrel portions of the bat may vary somewhat depending upon the style of the bat.

A flexible, high tensile strength, reinforcing member 18 extends longitudinally along the axis of the bat from the knob 13 into the tapered portion 15 of the bat. Member 18 comprises a high tensile strength, low specific gravity, flexible, small diameter rod. It usefully may comprise a composite of generally parallel, high strength fibers in a polymer matrix or it may comprise a drawn, small diameter rod of a high tensile strength polymer such as nylon or polypropylene. In a preferred embodiment, member 18 comprises a carbon fiber composite. In all cases, the diameter of member 18 is sufficient to provide adequate strength to maintain the barrel end of the bat in connection with the handle end upon breakage of the bat. Ordinarily, a diameter of about one-eighth inch is sufficient to provide member adequate strength to prevent bat separation even under the most extreme conditions.

Figure 2:
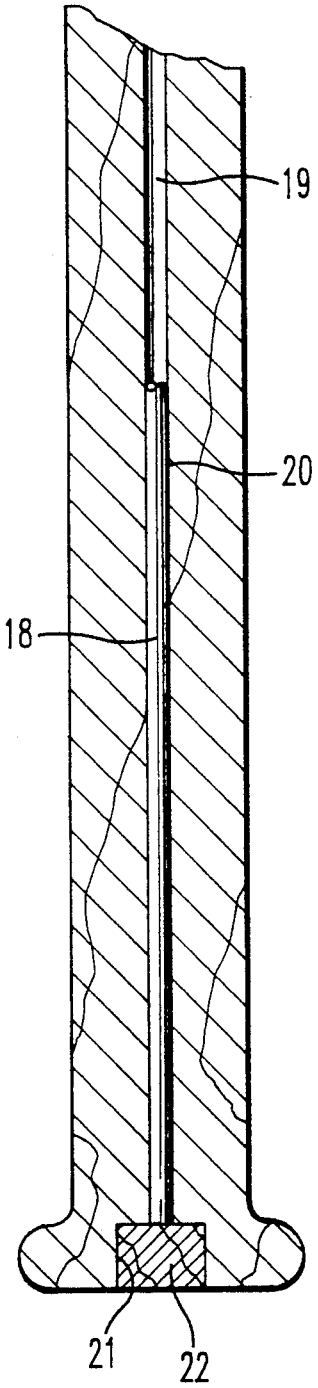
FIG. 2 is a longitudinal section of the handle end of a bat illustrating an embodiment of this invention.

In fabricating the reinforced bat of this invention, a hole 19, best shown in FIG. 2, is drilled or otherwise created longitudinally into the bat along its central axis from the handle end. The hole extends along the length of the bat through the handle section and into the taper portion of the bat. In most instances, bats break in use at a point above the batter's hands at the barrel end of the handle or within the small diameter part of the tapered portion 15 of the bat. A bat may split but it seldom breaks into two parts at a point in the large part of its taper or within its barrel portion. Therefore, reinforcing member 18 need extend only to a point as shown in the drawing beyond the handle portion of the bat and into the tapered portion.

Referring particularly to FIG. 2, reinforcing member 18 is bonded or otherwise securely attached within hole 19 over the entire surface 20 of the member Bonding of member 18 to the hole wall is conveniently accomplished using any high strength adhesive which is compatible both with the wood of the bat and the composition of reinforcing member 18. A liquid adhesive, for example, may be placed within hole 19 after which reinforcing member 18 may be inserted. As member 18 is inserted into hole 19, the liquid adhesive forms a film or coating over the entire surface 20 of member 18 with excess adhesive being forced out of the hole where it can be removed. Upon curing, the adhesive forms a bond between the outer surface of member 18 and the hole wall.

Reinforcing member 18 need not extend through the handle knob 13 to the very end of the bat but may instead stop short of the bat end as is shown in FIG. 2. In this embodiment, a circular recess 21 is formed in the knob end and this recess is closed with a plug 22 after installation of the reinforcing member 18 has been completed. Plug 22 is preferably of wood which matches the wood from which the bat is constructed.

In all cases, member 18 must be fabricated of a material which displays considerably less stiffness than does the wood of the bat so that the flex characteristics of the bat remain essentially unchanged. Composites of carbon or other high strength fibers in a polymer matrix meet that requirement as do drawn, small diameter, wire-like rods of plastics such as polypropylene. It is also important that member 18 be of relatively low specific gravity, below 2.5 and preferably below 2.0, so that the reinforcing member does not noticeably change the weight and balance of the bat. For example, using a carbon fiber composite of ⅛ inch diameter as the reinforcing member 18 adds only about one gram to the weight of the bat per inch length of member 18. Thus, were member 18 to extend for a distance of fifteen inches from the handle end of the bat, it would add only about fifteen grams, or about one-half ounce, to the weight of the bat.

While this invention has been described particularly in relation to a bat of the kind used in the game of baseball, it may advantageously be used as well for bats used in other sports such as softball and the like.

I claim:

1. A bat turned from a single piece of wood having a barrel portion of one diameter, a handle portion of a smaller diameter, a tapered portion intermediate the handle and barrel, and a reinforcing member; said reinforcing member comprising a high tensile strength, flexible rod having less stiffness than the wood from which the bat is fabricated and disposed within the bat longitudinally along the axis of the bat from the handle portion and extending into said tapered portion but terminating short of the barrel portion of said bat, the surface of said reinforcing member being bonded to said bat over the entire length of said member.

2. The bat of claim 1 wherein said reinforcing member comprises a composite of generally parallel, high strength fibers in a polymer matrix.

3. The bat of claim 2 wherein said fibers are carbon fibers.

4. The bat of claim 1 wherein said reinforcing member comprises a drawn, small diameter rod of a high tensile strength polymer.

5. The bat of claim 4 wherein said polymer is nylon.

6. The bat of claim 4 wherein said polymer is polypropylene.

7. The bat of claim 1 wherein said reinforcing member extends to a point within the bat about the midpoint of said tapered portion and is a carbon fiber composite having a diameter of about one-eighth inch.

8. The bat of claim 1 wherein the handle portion of said bat terminates in an integral knob forming a bat end, wherein said reinforcing member stops short of the bat end, and wherein a circular recess is formed in the knob end, said recess being closed with a plug which covers an end of said reinforcing member.

9. The bat of claim 1 wherein said reinforcing member is constructed of a material having a specific gravity less than 2.5.

* * * * *